US006638180B2

(12) United States Patent
Tsurumaki

(10) Patent No.: US 6,638,180 B2
(45) Date of Patent: Oct. 28, 2003

(54) GOLF CLUB

(75) Inventor: Masaei Tsurumaki, Tsubame (JP)

(73) Assignee: K.K. Endo Seisakusho (JP)

( * ) Notice: Subject to any disclaimer, the term of this patent is extended or adjusted under 35 U.S.C. 154(b) by 0 days.

(21) Appl. No.: 10/208,230

(22) Filed: Jul. 30, 2002

(65) Prior Publication Data

US 2003/0027661 A1 Feb. 6, 2003

(30) Foreign Application Priority Data

Jul. 31, 2001 (JP) ..... 2001-231227

(51) Int. Cl.[7] ..... A63B 53/04
(52) U.S. Cl. ..... 473/329; 473/345
(58) Field of Search ..... 473/324, 342, 473/345, 346, 349, 329, 350

(56) References Cited

U.S. PATENT DOCUMENTS 5,328,176 A * 7/1994 Lo
5,431,396 A * 7/1995 Shieh
5,669,827 A * 9/1997 Nagamoto
6,010,411 A * 1/2000 Reyes

FOREIGN PATENT DOCUMENTS

| | | |
|---|---|---|
| JP | 11-114105 A | 4/1999 |
| JP | 11-244428 A | 9/1999 |
| JP | 2001-58015 A | 3/2001 |
| JP | 2001-62004 A | 3/2001 |

* cited by examiner

*Primary Examiner*—Sebastiano Passaniti
(74) *Attorney, Agent, or Firm*—Akerman Senterfitt

(57) ABSTRACT

A golf club whose ball-striking portion realizes an improved repulsive force against balls and improved durability of as face member against repeated strikes of balls. The face member 16 is made up of a plurality of metallic plates 20, 21 which are superimposed over an entire surface thereof. Each of the metallic plates has an outer peripheral edge extended rearwardly to form an extended portion 22. The extended portion 22 has a rear end portion 23 joined to a body member 17 and a crown member 18 which construct a rear part of the head 1. A repulsive force of the ball-striking portion against balls can be improved by making the metallic plates 20, 21 thinner and more flexible. The durability of the face member 16 can be improved by transmitting the impacts caused by the repeated strikes of balls to the body member 17 and the crown member 18.

5 Claims, 2 Drawing Sheets

GOLF CLUB

BACKGROUND OF THE INVENTION a) Field of the Invention

The present invention relates to a golf club including a hollow head formed by joining a plurality of metallic shells together and a shaft connected to one side of the head.

b) Prior Art

Whilst metallic golf clubs with hollow head structure have been widely used, it is desirable for a ball striking portion to develop a larger repulsive force against balls in order to elongate the traveling distance of balls. To realize such lager repulsive force, the thickness of a face member serving as a ball striking portion may be thinned to thereby enlarge the deflection of the face member at the time of striking a ball. This, however, causes a problem that the thinned face member will have lowered durability.

Conventional solutions for solving the above-mentioned problem are disclosed in Japanese Un-Examined Patent Publication Nos.11-114105, 11-244428, 2001-58015 and 2001-62004, all of which disclose multi-layered face, enlarging the repulsive force by thinning the face member while improving the durability thereof. However, when a conventional golf club is tested after it is manufactured by thinning a face and superimposing a metal plate on a surface of the face only, it has been revealed that although the repulsive force is surely enhanced, there is a practical problem in respect of durability as the superimposed metal plate has turned out to come off due to only 500 times strikes of balls After careful study of any cause of the above problem, it has been revealed that whilst the multi-layered face member according to conventional art can surely enhance the repulsive force against balls by thinning each metal plate which constructs the face member, but a portion of the metal plate that is joined to an outline of the face surface is likely to become fragile tissue, depending on how firmly it is joined by welding or the like. In that case, shocks caused by the repeated strikes of balls will urge the metal plate to come off from the joined portion, so that the joined portion will be destructed easily. Although the durability can be surely improved by joining the metal plate to the face portion at a ball striking portion by means of welding or the like, it would then make no difference from the face member formed from a single thick plate, and no improvement of durability would be able to be expected.

SUMMARY OF THE INVENTION

To eliminate the above-mentioned problems, it is, therefore, a main object of the present invention to provide a golf club with improved durability of a face ember against the repeated strikes of balls as well as improved repulsive force against balls developed in the ball striking portion.

To attain the above object, there is provided, in accordance with a first aspect of the invention, a golf club including a head and a shaft connected to one side of the head, said head including a hollow body formed by combining a plurality of metallic shells inclusive of a face member which is provided with a ball-striking portion on a front, wherein said face member is made up of a plurality of metallic plates which are superimposed over an entire surface thereof, each of said metallic plates having an outer peripheral edge extended rearwardly to define an extended portion, said extended portion having a rear end portion joined to a rear shell which constructs a rear part of said head.

Accordingly, a repulsive force of the ball-striking portion against balls can be improved by making each of the face-member-constructing metallic plates thinner and more flexible. Further, the durability of the face member can be improved by extending rearwardly the outer periphery of the metallic plates which construct the face member, as the impacts caused by the repeated strikes of balls are allowed to be transmitted to the rear shell of the head, without being directed to the direction to make the metallic plates separate from each other.

A golf club according to a second aspect of the invention is a golf club of the first aspect, wherein said plurality of metallic plates which construct said face member are not mutually joined at least in said ball-striking portion.

Accordingly, as the plurality of metallic plates which construct the face member are effectively bent in the ball-striking portion, the repulsive force of the ball-striking portion against balls can be improved.

A golf club according to a third aspect of the invention is a golf club of any of the foregoing aspects, wherein the thickness of said ball-striking portion is less than 3.0 mm, while said extended portion is thinner than said ball-striking portion.

By making the ball-striking portion relatively thick, the durability of the face member against the repeated strikes of balls can be improved.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DESCRIPTION OF PREFERRED EMBODIMENTS

Figure 1:
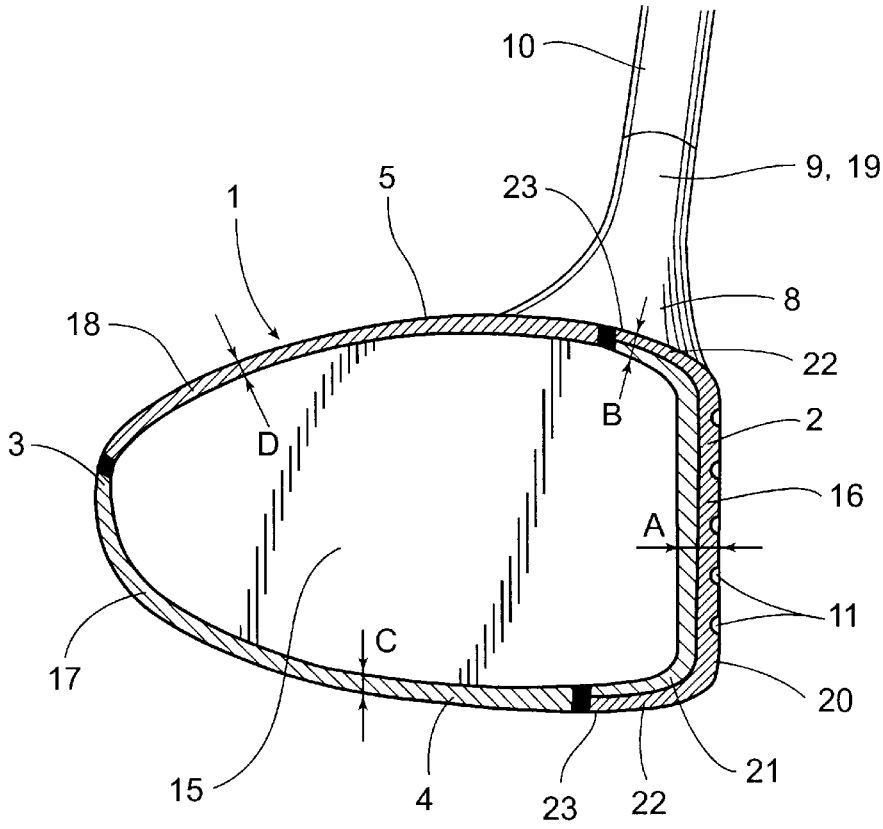
FIG. 1 is a transverse section of a golf club according to an embodiment of the invention.
Figure 2:
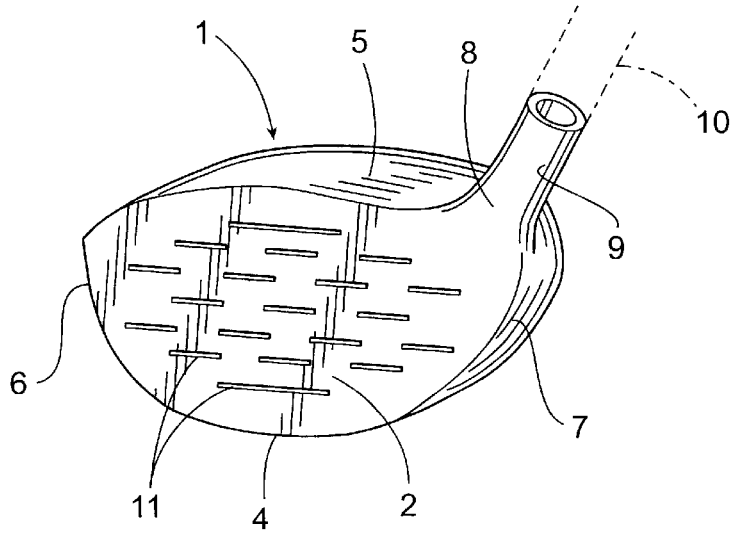
FIG. 2 is a perspective view of the golf club of FIG. 2.
Figure 3:
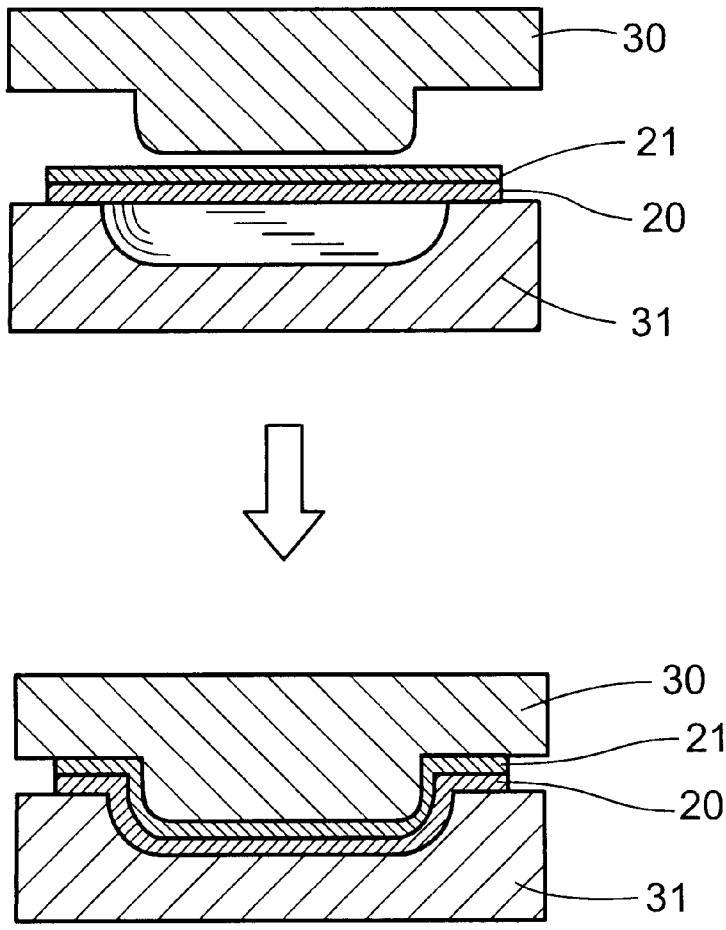
FIG. 3 is a section illustrating a pressing process relative to a face member of the golf club of FIG. 1.

Hereinafter will be described embodiments of the invention with reference to the attached drawings, in which a wood golf club is described as an example. Reference numeral 1 designates a metallic hollow head or so-called metal wood club head, including a face 2 for striking balls on a front, a back 3 on a rear side, a sole 4 on a bottom, a crown 5 on a top, a toe 6 on one side, a heel 7 on the other side, a neck 8 formed above the heel 7 and a hosel 9 protruding upwardly from the neck 8. The hosel 9 serves as a connecting portion for connecting a shaft 10 thereto. In the meantime, the face 2 is formed with a plurality of score lines 11.

The head 1 is constructed by combining a plurality of metallic shells made from titanium, titanium alloy or the like, including a hollow interior denoted by a hollow portion 15. In other words, an outer shell of the head 1 is made up of three tabular metallic shells, i.e., a face member 16, a body member 17 and a crown member 18. The face member 16 is mainly to form the face 2, the crown member 18 mainly to form the crown 5, while the body member 17 is to form the remaining portion such as a peripheral portion including the back 3 and a bottom portion or the sole 4. These face member 16, body member 17 and crown member 18 are welded to one another by welding or the like. The aforesaid neck 8 and hosel 9 are each formed of a hosel member 19 which is metallic and tube-shaped.

The face member 16 is formed of two metal plates 20 and 21, which are laid upon the other over an entire surface thereof, including an extended portion 22 protruding from the outer peripheral edge of the metallic plates 20 and 21 rearwardly. In other words, the face member 16 forms not only the face 2 but also a part of the crown 5 and the sole 4 extending from the face 2. A rear end 23 of the extended portion 22 is joined to the body member 17 serving as a back shell for forming the rear part of the head 1 and the crown member 18 by welding or the like. The two metallic plates 20 and 21 are each joined to the body member 17 and the crown member 18.

The face member 16 is formed by laying the first metallic plate 20 upon the other metallic plate 21 and then press-forming the same. Accordingly, whilst the two metallic plates 20 and 21 are closely contacted by each other, they remain separate without being joined to each other, so that they are benable independently when striking balls. In the meantime, the metallic plates 20 and 21 have only to be mutually unjoined at least in the face 2, and thus they may, in some cases, be joined to each other in the extended portion 22 by welding or the like.

In a preferred form of the invention, the thickness of the face 2 as a ball striking portion of the head 1, i.e., the thickness A of the superimposed metallic plates 20 and 21 is 2.75 mm, the thickness B of the neighborhood of the rear end portion 23 of the extended portion 22 is 1.5 mm, the thickness C of the sole is 1.15 mm, and the thickness D of the crown 5 is 1.0 mm, respectively. In order to make the head 1 as large as possible and to enlarge a certain area on the face 2 for the hit balls to be able to travel straight and longer, the thickness A of the face 2 may desirably be less than 3.00 mm, and the thickness B of the extended portion 22 where no balls are hit may desirably be less than the thickness A. On the other hand, if the thickness A of the face 2 is less than 2.5 mm, there would occur a problem in respect of the durability of the face 2 when striking balls, and thus it is not desirable.

Next, a method for manufacturing the head 1 will be described.

First, plate materials made of titanium, titanium alloy or the like are press worked into a desired configuration to fabricate the aforesaid metallic shells such as the face member 16, the body member 17 and the crown member 18, respectively. Then, the face member 16, the body member 17 and the crown member 18, together with the hosel member 19 as the tube member are joined together and welded to one another, so that the hollow body which eventually becomes the head 1 is formed. Then, the head prototype is subjected to grinding process, loft and lie angles adjusting process, heat treatment process and painting process so that it is finished to a final product or the head 1.

Hereinafter will be described the detailed description of the method for manufacturing the face member 16 according to the present invention. In the present embodiment, titanium alloy: Ti-4.5A1-3V-2Fe-2Mo was used as a material of the face member 16. The material of the face 16 should not be limited to it but any other suitable material may be used. In the case that titanium alloy is to be used, alpha+beta type such as 6-4 titanium would be preferred from a manufacturing point of view.

Initially, the two metallic plates 20 and 21 are prepared by cutting Ti-4.5A1-3V-2Fe-2Mo plate of 1.5 mm thickness to a size of 150 mm×110 mm, respectively. Then, the two metallic plates 20, 21 are superimposed and their corners are temporality welded. An upper die 30 and a lower die 31 are placed inside a furnace of a special press machine equipped with a heating furnace, and then the furnace temperature is set at 800 degrees centigrade. When the temperature in the dies become substantially as high as the furnace temperature, the metallic plates 20, 21 are placed on the lower die 31 and then press-worked when the temperature of the metallic plates 20, 21 rise highly enough. A clearance is provided between the upper die 30 and the lower die 31 in order that the thickness of the face member 16 after the press-working may be smaller than the thickness of the superimposed metallic plates 20 and 21 prior to the press-working. In the present embodiment, such clearance is set so that a finished face member may have a 2.75 thickness in the face 2 and a 1.5 mm thickness in the vicinity of the rear end 23 of the extended portion 22. After the press working, unnecessary outer peripheral portions are removed by trimming, to thereby obtain the face member 16.

For the body member 17 which eventually becomes a rear shell and the crown member 18 is used the same titanium alloy material as the one used for the face member 16, which is press worked to define a 1.15 mm thickness in the sole 4 and a 1.0 mm thickness in the crown 5, respectively. Then, the body member 17 and the crown member 18 are joined to each other by welding or the like, while the rear end 23 of the face member 16 is joined to the body member 17 and the crown member 18. In the present embodiment, both of the two metallic plates 20, 21 are joined to the body member 17 and the crown member 18. Thereafter, the head 1 is finished through predetermined processes.

Then, the golf club of the embodiment thus obtained was tested in respect of repulsive force and durability. A conventional golf club was prepared as a comparative example, in which a face surface was formed thin while only the face was formed to have a dual structure by superimposing the metallic plates, with the thickness of the remaining respective metallic shells being the same as that of the golf club in accordance with the present embodiment. Table 1 shows the result of the test, indicating that a face plate of the conventional golf club was broken away due to only 500 times strikes of balls while no changes occurred in the golf club of the present embodiment even after 2000 times strikes thereof.

TABLE 1

| | | Durability | | |
|---|---|---|---|---|
| | Repulsive force C.O.R | Head Speed (m/s) | Number of Strikes | Result |
| Golf Club of the Embodiment | 0.86 | 4.3 | 2,000 | No change |
| Conventional Golf Club | 0.85 | 4.3 | 500 | Face broken away |

As is apparent from the foregoing, a golf club in accordance with the foregoing embodiment includes the head 1 and the shaft 10 connected to one side of the head 1, said head 1 including the hollow body formed by combining a plurality of metallic shells inclusive of the face member 16 which is provided with the ball-striking face 2 on a front, wherein said face member 16 is made up of a plurality of the metallic plates 20 and 21 which are superimposed on each other over an entire surface thereof, each of said metallic plates 20 and 21 having outer peripheral edge extended rearwardly to define the extended portion 22, said extended portion 22 having the rear end portion 23 joined to the body member 17 and the crown member 18 which construct the rear shell of the head 1.

Accordingly, the repulsive force of the face 2 against balls can be improved by thinning the respective metallic plates 20 and 21, and at the same time the durability of the face member 16 can be improved by extending rearwardly the outer peripheral edge of the metallic plates 20, 21 which construct the face member 16, as the impacts caused by the repeated strikes of balls do not function to separate the metallic plates 20, 21 from each other but transmit to the body member 17 and the crown member 18, so that the durability of the face member 16 can be improved.

Further, the plurality of metallic plates 20 and 21 which construct the face member 16 in accordance with the embodiment of the invention are not joined to each other at least in the face 2 which serves as a ball striking portion.

Accordingly, the plurality of metallic plates 20 and 21 are allowed to be effectively bent, so that the repulsive force of the face 2 against balls can be improved.

Specifically, the thickness of the face 2 according to the embodiment is less than 3.0 mm, while the extended portion 22 is thinner than the face 2.

Accordingly, the durability of the face member 16 against the repeated strikes of balls can be improved by making the thickness of the face 2 larger.

Incidentally, the present invention should not be limited to the foregoing embodiments, but may be variously modified within a scope of the invention. Although the face member 16 is formed of the two metallic plates 20, 21 in the foregoing embodiment, it may be formed of three or more metallic plates. Further, although the rear shell is of a two-piece structure comprising the body member 17 and the crown member 18 in the foregoing embodiment, it may be formed of three or more pieces. Whilst the press machine equipped with the heating furnace is used in press working the face member 16 in the foregoing embodiment, an ordinary type press machine which is not equipped with such heating furnace also may be used. The present invention is applicable to a hollow type iron golf club, though a wood golf club was taken as an example in the foregoing embodiment.

What is claimed:

1. A golf club including a head and a shaft connected to one side of the head, said head including a hollow body formed by combining a plurality of metallic shells inclusive of a face member which is provided with a ball-striking portion on a front, wherein said face member is made up of a plurality of metallic plates which are superimposed over an entire surface thereof, each of said metallic plates having an outer peripheral edge extended rearwardly to define an extended portion, said extended portion having a rear end portion joined to a rear shell which constructs a rear part of said head.

2. A golf club according to claim 1, wherein said plurality of metallic plates which construct said face member are not mutually joined at least in said ball-striking portion.

3. A golf club according to claim 1, wherein the thickness of said ball-striking portion is less than 3.0 mm, while said extended portion is thinner than said ball-striking portion.

4. A golf club according to claim 2, wherein the thickness of said ball-striking portion is less than 3.0 mm, while said extended portion is thinner than said ball-striking portion.

5. A golf club according to claim 1, wherein said rear shell is formed of a body member and a crown member.

* * * * *